US006700986B2

(12) United States Patent
Ootsu et al.

(10) Patent No.: US 6,700,986 B2
(45) Date of Patent: Mar. 2, 2004

(54) MICROPHONE CHARACTERISTIC ADJUSTMENT DEVICE

(75) Inventors: Takeo Ootsu, Tokyo (JP); Takeaki Oohira, Kanagawa-ken (JP)

(73) Assignee: Vertex Standard Co., Ltd. (JP)

( * ) Notice: Subject to any disclaimer, the term of this patent is extended or adjusted under 35 U.S.C. 154(b) by 151 days.

(21) Appl. No.: 10/144,019

(22) Filed: May 13, 2002

(65) Prior Publication Data

US 2002/0168077 A1 Nov. 14, 2002

(30) Foreign Application Priority Data

May 14, 2001 (JP) ..... 2001-143795

(51) Int. Cl.[7] ..... H04R 25/00
(52) U.S. Cl. ..... 381/357; 381/355; 381/358
(58) Field of Search ..... 381/313, 355, 381/356, 357, 358, 360, 361, 369, 375, 170

(56) References Cited

U.S. PATENT DOCUMENTS 5,781,644 A * 7/1998 Chang ..... 381/355
5,933,510 A * 8/1999 Bryant et al. ..... 381/355
6,091,828 A * 7/2000 Akino et al. ..... 381/355

* cited by examiner

*Primary Examiner*—Suhan Ni
(74) *Attorney, Agent, or Firm*—Fulwider Patton Lee & Utehct, LLP

(57) ABSTRACT

An acoustic mechanism is provided for a microphone, by which the transmission sensitivity-vs.-frequency characteristic of the microphone can be adjusted by an easy operation. Good communication quality can be thereby invariably secured for radio communications, and a preferred communication sound can also be obtained.

Elongated openings 16*a* and 16*b* that are long in a periphery direction are formed in the peripheral wall portion of a housing 11 of a microphone main unit 1. Hollow cylindrical packing 2 made of rubber, in which elongated openings 21*a* and 21*b* are formed at locations corresponding to the positions of the elongated openings 16*a* and 16*b* in the housing 11, is fitted over the housing 11 for securing. A hollow, cylindrical adjustment ring 3 where slits 32*a* and 32*b* are formed at locations corresponding to the positions of the elongated openings 21*a* and 21*b* is fitted over the periphery of the packing 2. It is arranged such that the adjustment ring 3 can be rotated while keeping in contact with the packing 2. When the adjustment ring 3 is rotated, communication paths that communicate a space formed behind a diaphragm in the housing 11 of the microphone main unit 1 with an external space, having sizes according to the rotation angle of the adjustment ring 3, can be formed.

3 Claims, 6 Drawing Sheets

MICROPHONE CHARACTERISTIC ADJUSTMENT DEVICE

BACKGROUND OF THE INVENTION

1. Field of the Invention

The present invention relates to a device for adjusting the characteristic of a microphone. More specifically, the invention relates to a device that can adjust a transmission sensitivity-vs.-frequency characteristic by an easy operation according to a communication state and a noise environment, thereby invariably ensuring good communication quality.

2. Description of the Related Art

As a traditional method of adjusting the transmission sensitivity-vs.-frequency characteristic of a microphone, it is common practice to employ an additional electronic circuit such as a microphone equalizer. As a method of acoustically adjusting the transmission sensitivity-vs.-frequency characteristic by the main unit of the microphone, a housing that contains microphone elements is drilled in advance, and a resulting opening is covered with a thin piece of Japanese paper or a cloth.

Specifically, in the case of a dynamic microphone, a magnet, a magnetic circuit, and a damping material are provided at the back of a diaphragm in the microphone. Then, by means of a hollow, cylindrical housing with its back surface sealed, a space that contains these members is formed. In addition, an opening is formed in the peripheral wall portion or the back surface of the housing. Then, by sealing the opening with a piece of Japanese paper or a cloth, it is arranged such that an appropriate pressure is applied to the back surface of the diaphragm that vibrates by a sound pressure.

If the space behind the diaphragm is completely sealed, a response at low frequencies deteriorates. On the contrary, if the above-mentioned method is employed, acoustic low-frequency compensation becomes possible because the piece of Japanese paper or the cloth functions as a certain acoustic resistive element. Thus, in most cases, the quality of communication that is easily audible can be thereby obtained.

The method of performing the low-frequency compensation like the one described above is adopted in various forms in telephones and headphones.

The method of acoustically adjusting the transmission sensitivity-vs.-frequency characteristic by means of the microphone main unit has the advantage of preventing distortion and deterioration in an SN ratio, compared with the method of electrically adjusting the transmission sensitivity-vs.-frequency characteristic by means of the microphone equalizer circuit. However, in regard to the method described above, the following problems are pointed out.

First, generally, if the transmission sensitivity-vs.-frequency characteristic is flat in an audio-frequency band, it is said that good communication quality can be obtained. However, in radio communication apparatuses such as amateur radio communication apparatuses, an audio signal that is easily audible is not always obtained in normal conditions as described above. Thus, the communication quality varies according to a communication state and a noise environment.

Accordingly, in order to ensure good communication quality, it is not enough to perform uniform low-frequency compensation alone, as seen in the above-mentioned conventional art, so that means for allowing adjustment to and setting the characteristic is required.

Further, upon reception of a notification that an audio output reception state is not satisfactory during communication, the radio communication apparatus should address this state immediately. However, the causes of this state are diverse, so that even if a receiving side makes micro adjustment to the communication frequency bands such as using a WIDTH function or a SHIFT function in the communication apparatus, this state cannot always be improved. Even a skilled operator is bothered by the operation of addressing this state.

The present invention therefore has been made with the object of providing a microphone having a configuration that can adjust the transmission sensitivity-vs.-frequency characteristic by an easy operation. According to the present invention, just by performing a quick operation on the microphone, good communication quality can be ensured in a radio communication apparatus.

SUMMARY OF THE INVENTION

The present invention relates to a microphone characteristic adjustment device, which comprises a microphone main unit that contains microphone elements in a hollow, cylindrical housing with its back surface sealed. The housing includes a diaphragm disposed on its front side and openings are formed in the peripheral wall portion of the housing, for communicating a space formed behind the diaphragm with the outside of the housing. The microphone characteristic adjustment device further comprises packing formed of an elastic member, being fitted over or wound around the periphery of the microphone main unit for securing. Openings are formed in the packing at locations corresponding to the positions of the openings in the housing of the microphone main unit. The microphone characteristic adjustment device still further comprises an adjustment ring, having a hollow, cylindrical shape to be fitted over the periphery of the packing, for rotating around the periphery of the packing while keeping in contact with the periphery of the packing to form a ventilation path for setting one of the openings in the packing to be communicated with the outside or not to be communicated.

According to the present invention, the space formed behind the diaphragm in the microphone main unit is communicated with the outside through the openings formed in the housing, the openings in the packing, and the ventilation path in the adjustment ring. Then, by rotating the adjustment ring, the communication state and the noncommunication state can be set. In other words, whether low-frequency compensation in the transmission sensitivity-vs.-frequency characteristic should be provided or not can be selectively set.

Further, if the openings in the microphone main unit, the openings in the packing, and the ventilation path in the adjustment ring are formed to be elongated in the periphery direction, the cross-sectional area of a communication path can be gradually changed according to the rotation angle of the adjustment ring. The transmission sensitivity-vs.-frequency characteristic can be thereby changed smoothly.

Further, if the width of the elongated openings in the packing is varied along the periphery direction, the above-mentioned characteristic with respect to rotation of the adjustment ring can also be changed nonlinearly.

Since the elastic member is employed for the packing, the adjustment ring is fitted over the packing, insuring an appropriate fit. The adjustment ring is thereby rotated around the packing, while keeping in contact with the packing. Due to this appropriate frictional relationship, an adjustment operation is facilitated. In addition, even if the microphone undergoes vibration, the problem of sound absorption resulting from rattling of the adjustment ring can be prevented. In addition to rubber, resins such as felt can also be employed as a material for the packing.

The various features of novelty which characterize the invention are pointed out with particularity in the claims annexed to and forming a part of this specification. For a better understanding of the invention, its operating advantages, and specific objects attained by its use, reference should be had to the accompanying drawing and descriptive matter in which there is illustrated and described a preferred embodiment of the invention.

BRIEF DESCRIPTION OF THE DRAWINGS

FIG. 1(*b*) is a side view of the microphone according to an embodiment of the present invention;

DETAILED DESCRIPTION OF THE PREFERRED EMBODIMENTS

Now, a microphone characteristic adjustment device according to an embodiment of the present invention will be described in detail with reference to drawings.

Figure 1:
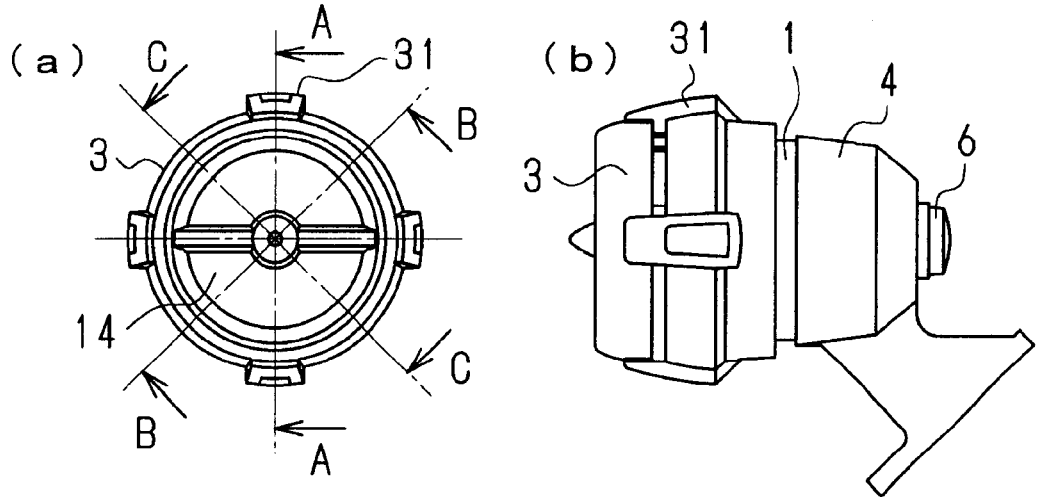
FIG. 1(*a*) is a top view of a microphone according to an embodiment of the present invention.
Figure 2:
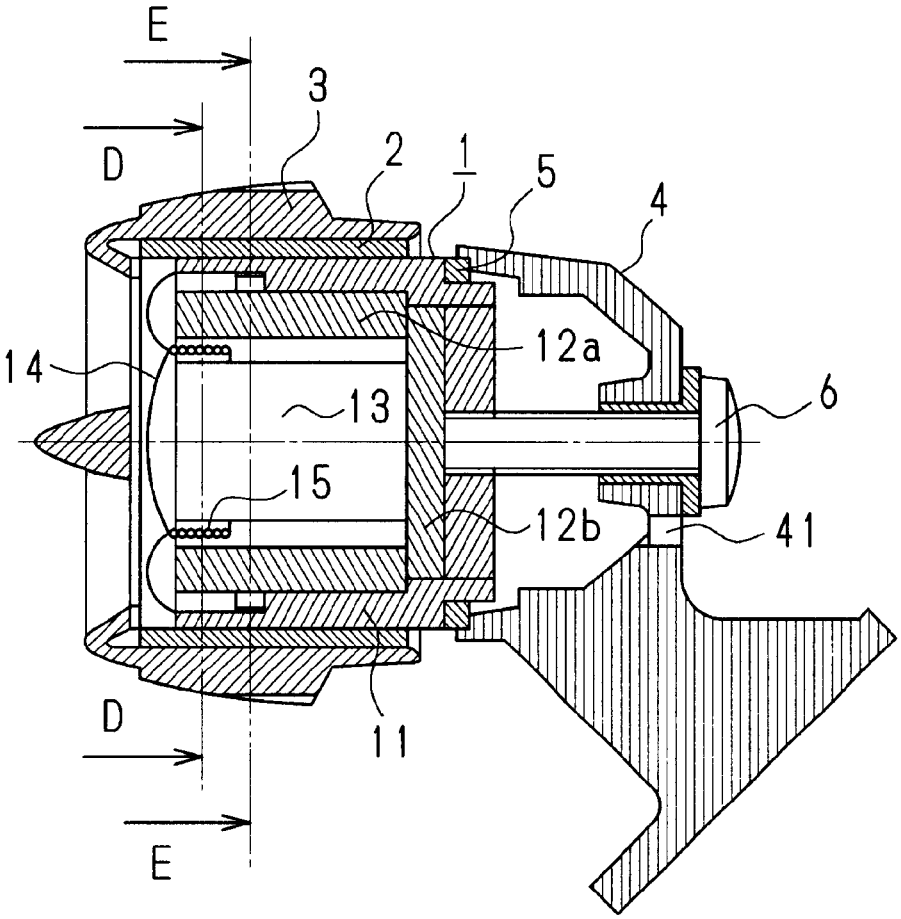
FIG. 2 is a sectional view through line A—A in FIG. 1(*a*) corresponding to the sectional view of the microphone taken along an axis direction thereof.

First, FIG. 1(*a*) is a top view of a microphone according to the embodiment of the present invention, and FIG. 1(*b*) is a side view of the microphone. FIG. 2 is a sectional view through line A—A in FIG. 1(*a*), corresponding to the sectional view of the microphone taken along its axis direction.

Referring to FIG. 2, reference numeral 1 denotes a microphone main unit, reference numeral 2 denotes packing made of rubber, reference numeral 3 denotes an adjustment ring, and reference numeral 4 denotes a mounting base. The adjustment ring 3 and the mounting base 4 are formed of an aluminum die casting or a molded plastic.

The packing 2 is fit over or wound around the periphery of the microphone main unit 1 for securing. The adjustment ring 3 is appropriately fit over the packing 2.

Then, the back ends of these assemblies are fitted into a mouth in the mounting base 4 through washers 5 that comprise an elastic member. By fastening the rear end of the microphone main unit 1 to the mounting base 4 by means of a screw 6, the assemblies as a whole are mounted to the mounting base 4.

Incidentally, the microphone main unit 1 contains microphone elements in a hollow, cylindrical housing 11 of which the back end is sealed.

Specifically, hollow, cylindrical yokes 12*a* are fitted to the inside of the housing 11, and a disc-shaped yoke 12*b* is provided for the inside surface of the back end of the housing 11 to constitute a magnetic circuit. Then, a cylindrical magnet 13 is mounted to the center of an axis, and the outer edge of a diaphragm 14 is fully attached to the front end of the housing 11. In addition, hollow, cylindrical, movable coils 15 are attached to the back of the diaphragm 14. Each coil is inserted into a clearance between each of the yokes 12*a* and the magnet 13.

Though not shown, two thin lead wires are led out from the movable coils 15, connected to respective terminals provided on the back-end board of the housing 11 through the yoke 12*b*, and then led out to the outside from the respective terminals via an opening 41 formed in the mounting base 4.

Figure 3:
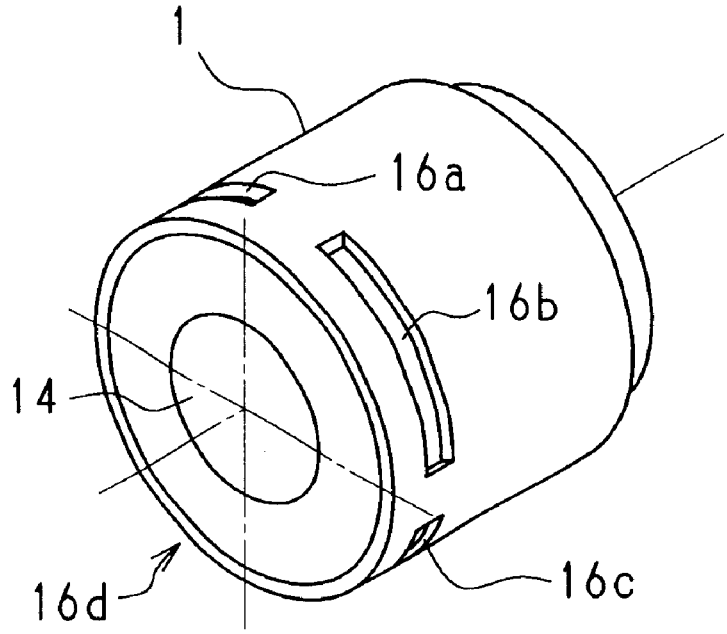
FIG. 3 is a perspective view showing an outward appearance of a microphone main unit.
Figure 4:
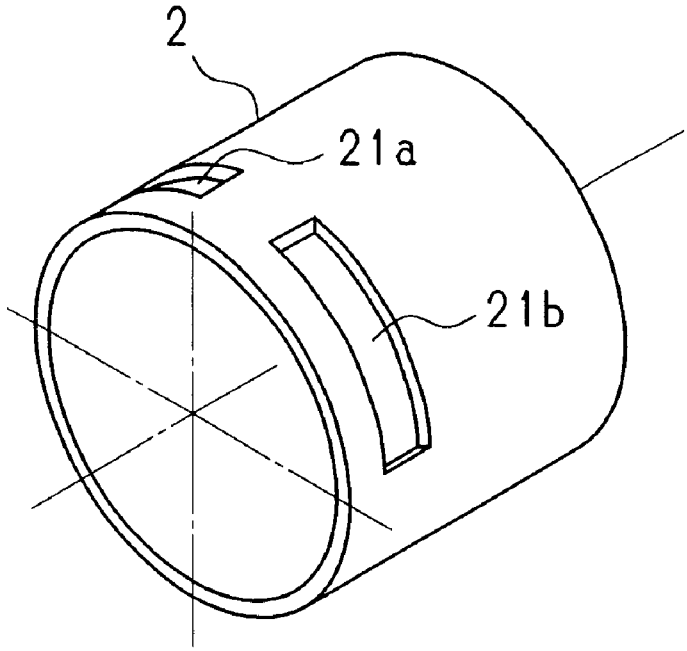
FIG. 4 is a perspective view showing an outward appearance of packing.

Then, though not clear from FIGS. 1 and 2, four elongated openings 16*a* to 16*d* that are long in the direction of the periphery of the housing 11 are formed in the housing 11 of the microphone main unit 1. As shown in FIG. 3, the elongated openings 16*a* to 16*d* are disposed such that they mutually form an angle of 90° from the center of the axis of the microphone main unit 1. Further, as shown in FIG. 4, elongated openings 21*a* and 21*b* are formed at the locations in the packing 2 that correspond to the positions of two adjacent elongated openings 16*a* and 16*b* in the housing 11. As shown, the elongated openings 21*a* and 21*b* in the packing 2 have a width greater than the width of the elongated openings 16*a* to 16*d* in the housing 11.

Figure 5:
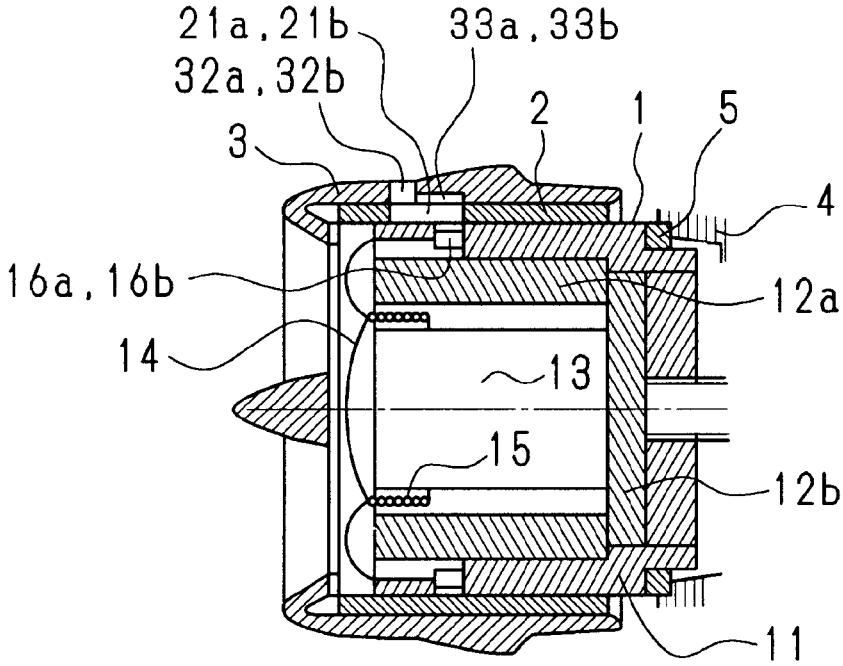
FIG. 5 is a sectional view through line B—B or C—C in FIG. 1(*a*)

Accordingly, a sectional view through line B—B or C—C in FIG. 1(*a*) becomes the one shown in FIG. 5. A space in the housing 11, formed behind the diaphragm 14 thereby communicates with the periphery of the packing 2 through the long openings 16*a* to 16*d* in the housing 11 and the long openings 21*a* and 21*b* in the packing 2. The centers of the communication paths are at the positions that form angles of ±45° from vertical lines passing through the center of the axis. The packing 2 fits over the housing 11 such that the rear sides of the long openings 21*a* and 21*b* in the width direction are aligned over the long openings 16*a* and 16*b*.

On the other hand, the adjustment ring 3 has a basic form of a hollow cylinder, and fits over the periphery of the packing 2. Ventilation paths that are elongated in the periphery direction are formed at the locations corresponding to the positions of the elongated openings 21*a* and 21*b* in the packing 2 shown in FIGS. 1(*a*) and 1(*b*). As shown in FIGS. 1(*a*) and 1(*b*), visually, it looks as if slits are formed at the respective locations. Four protrusions 31 added to the periphery of the adjustment ring 3 are provided to facilitate of the operation of rotating the adjustment ring 3, in consideration of the design of the microphone as well.

Figure 6:
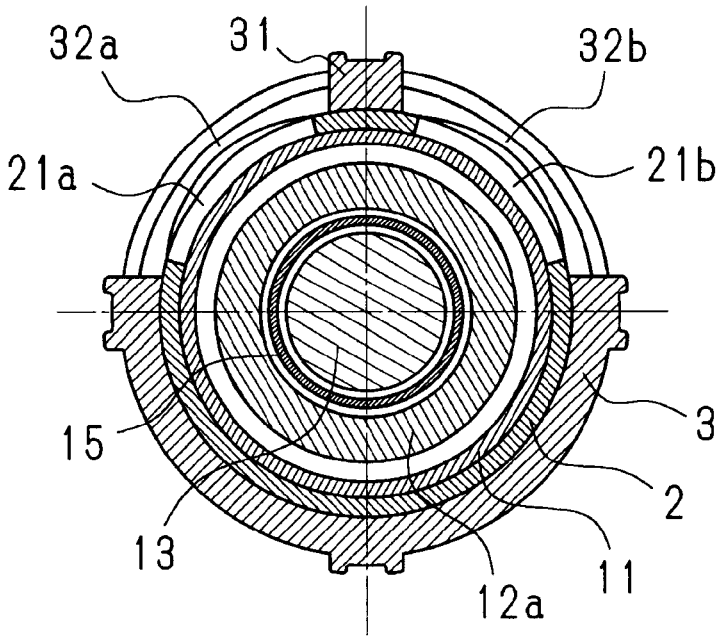
FIG. 6 is a sectional view through line D—D in FIG. 2.

The details of the slits will be described with reference to FIGS. 6 and 7, in addition to FIG. 5. FIG. 6 is a sectional view through line D—D in FIG. 2, while FIG. 7 is a sectional view through line E—E in FIG. 2.

First, as shown in FIG. 6, slits 32*a* and 32*b*, which are shaped like elongated openings that are narrower than the elongated openings 21*a* and 21*b* in the packing 2, are formed at the locations corresponding to the front sides of the elongated openings 21*a* and 21*b* in the width direction.

Figure 7:
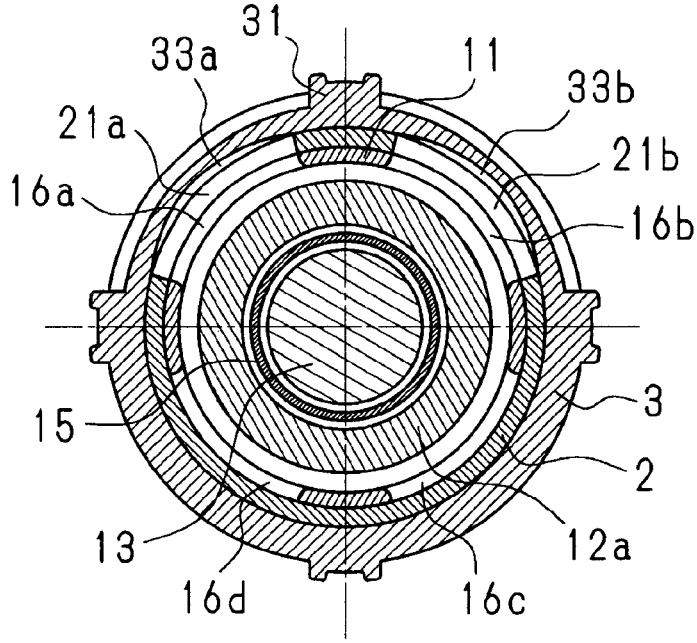
FIG. 7 is a sectional view through line E—E in FIG. 2.

As shown in FIG. 7, the slits 32*a* and 32*b* are not formed at the locations corresponding to the rear sides of the elongated openings 21*a* and 21*b* in the packing 2 in the width direction. Instead of these slits, shallow depressions 33*a* and 33*b* that are shaped like arcs of which the curvature is smaller than the periphery radius of the packing 2 are formed in the inside of the adjustment ring 3.

Accordingly, in the state where the slit 32*a* of the adjustment ring 3 is aligned over the elongated opening 21*a* of the packing 2 at the same angle in the peripheral direction and the slit 32*b* of the adjustment ring 3 is aligned over the elongated opening 21*b* of the packing 2 at the same angle in the periphery direction, the space in the housing 11 formed to behind the diaphragm 14 of the microphone main unit 1 communicates with an external space at two locations through the elongated openings 16*a* and 16*b* in the housing 11, the elongated openings 21*a* and 21*b* in the packing 2 and the depressions 33*a* and 33*b* in the adjustment ring 3, and the slits 32*a* and 32*b* in the adjustment ring 3.

In this state, the largest communication paths are constituted in the device according to this embodiment.

The adjustment ring 3 fits over the packing 2 made of rubber as described above, insuring an appropriate fit, so that the adjustment ring 3 can be rotated around the packing 2, while keeping in contact with the packing 2.

Figure 8:
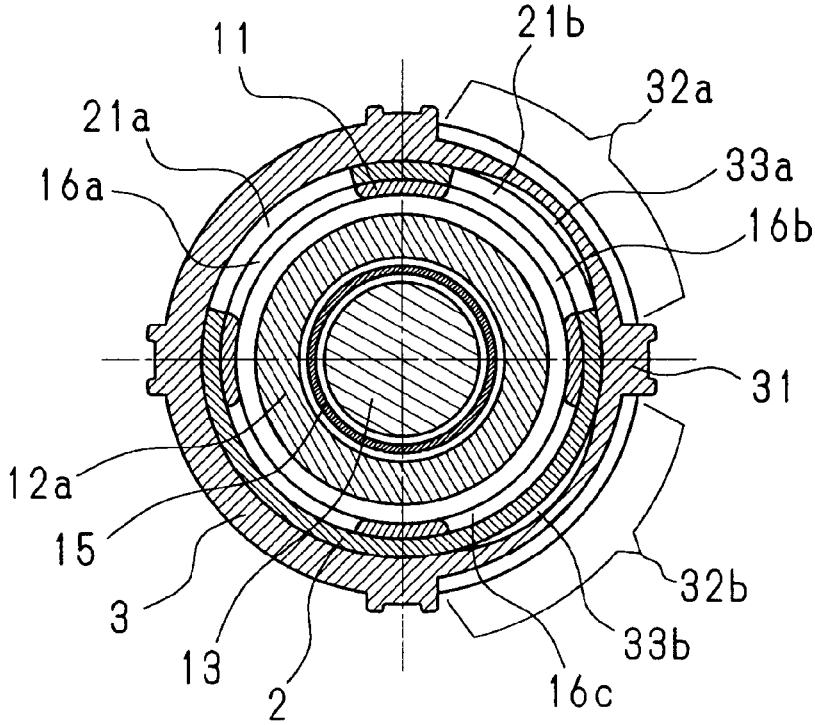
FIG. 8 is a sectional view through line E—E in FIG. 2 in which an adjustment ring is turned 90° counterclockwise.

If the adjustment ring 3 is rotated 90° counterclockwise from the state described above, the one slit 32*b* in the adjustment ring 3 is slid to the location where the elongated openings 21*a* and 21*b* in the packing are not present, while the other slit 32*a* is slid to the side of the elongated opening 21*b* in the packing 2, as shown in FIG. 8 that corresponds to the sectional view of FIG. 7 rotated 90° counterclockwise. Thus, only one half of the communication paths formed in the above-mentioned state are constituted.

Further 90° rotation causes both of the slits 32*a* and 32*b* in the adjustment ring 3 to be slid to the locations where the elongated openings 21*a* and 21*b* of the packing 2 are not present. Thus, no communication paths are constituted, so that the space in the housing 11 becomes completely sealed.

Hence, according to the device of this embodiment, when the adjustment ring 3 is 180° rotated from the state shown in FIG. 1, the state of long openings 16*a* and 16*b* in the microphone main unit 1 can be gradually changed from the fully open state to the fully closed state.

In other words, just by rotating the adjustment ring 3 that is fit over the microphone main unit 1, the transmission sensitivity-vs.-frequency characteristic of the microphone can be changed according to the angle of rotation of the adjustment ring.

Figure 9:
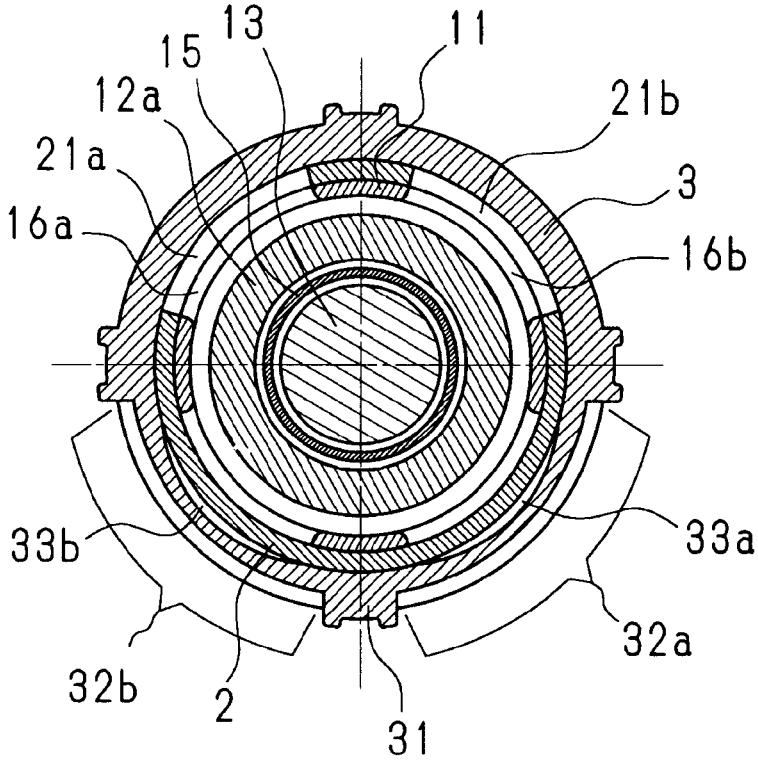
FIG. 9 is a sectional view through E—E in FIG. 2 in which the adjustment ring is turned 180° counterclockwise.
Figure 11:
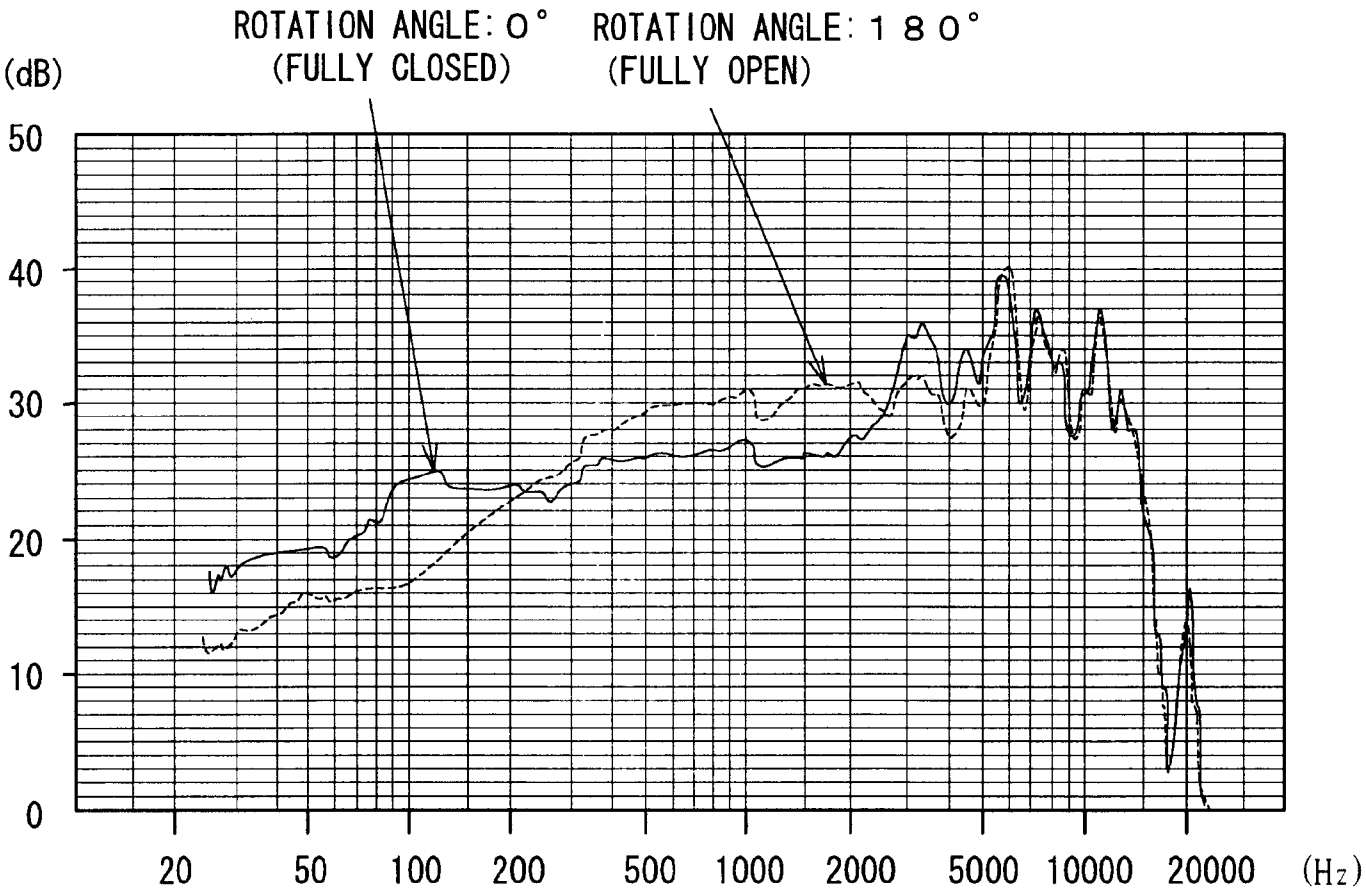
FIG. 11 is a graph showing transmission sensitivity-vs.-frequency characteristics of the microphone in a state where the rotation angle of the adjustment ring is 0° and a communication path is fully open and in a state where the rotation angle of the adjustment ring is 180° and the communication path is fully closed.

When the transmission sensitivity-vs.-frequency characteristics of the device according to this embodiment were measured in the states shown in FIGS. 1, 7, and 9, the results as shown in FIG. 11 were obtained. In the state shown in FIG. 7, the angle of rotation is 0° and the communication paths are fully open, and in the state shown in FIG. 9, which is 180° rotated from the state in FIG. 7, the communication paths are fully closed.

As clear from this graph, in the fully open state of the communication paths, gain attenuation occurs at frequencies higher than 250 Hz. However, at frequencies lower than 250 Hz, great gains are obtained. In the fully closed state of the communication paths, the tendency of response to the contrary is obtained.

FIG. 11 shows two states where the communication paths are fully open and closed. If the rotation angle of the adjustment ring 3 is intermediate between 0° and 180°, the intermediate state of the tendency of response is naturally obtained.

Hence, if the device according to this embodiment is applied to a microphone in the radio communication apparatus, upon reception of a notification that a received sound is not clear or difficult to hear due to noise from surroundings, the adjustment ring 3 can be rotated. Then, an inquiry can be made to a receiving party about the state of reception. The characteristic of the microphone can be thereby adjusted so as to obtain the best communication quality in that communication state.

Further, in amateur radio communications, it often happens that a preference for a received sound differs according to an operator. This difference can also be adjusted by an easy operation.

Figure 10:
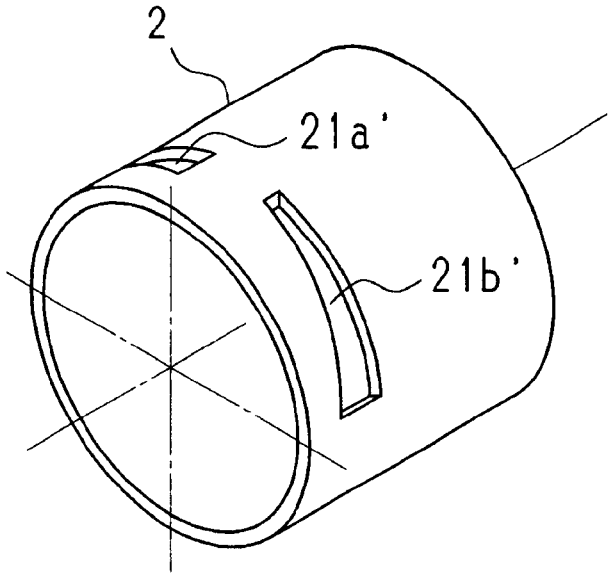
FIG. 10 is a perspective view showing an outward appearance of the packing.

In the embodiment described above, the elongated openings 21*a* and 21*b* are formed to have the uniform width, as shown in FIG. 4. However, the width of these openings may also be formed like wedges of which the width is gradually changed, as shown in FIG. 10.

If the elongated openings 21*a* and 21*b* shown in FIG. 4 are employed, the transmission sensitivity-vs.-frequency characteristic will change almost linearly according to rotation of the adjustment ring 3. If the widths of the elongated openings are varied like elongated openings 21*a*' and 21*b*' in FIG. 10, a nonlinear change in the transmission sensitivity-vs.-frequency characteristic such as the one employed for volume control can be realized. With this arrangement, an operation for changing sound quality can be sometimes facilitated.

In this embodiment, a description was directed to the case where two communication paths between the housing 11 of the microphone main unit 1 and an external space are present. The number of the communication paths may be just one, or three or more.

In this embodiment, a description was given about the dynamic microphone. However, the invention is also applicable to other types of microphones such as an electrostatic microphone.

Those skilled in the art will recognize further variations are possible within the scope claimed below.

What is claimed is:

1. A microphone characteristic adjustment device comprising:

a microphone main unit that contains microphone elements in a hollow, cylindrical housing with a back surface thereof sealed, said housing including a diaphragm disposed on a front side thereof and openings formed in a peripheral wall portion thereof for communicating a space formed behind said diaphragm with an outside of said housing;

packing formed of an elastic member, being fitted over or wound around a periphery of said microphone main unit for securing, openings being formed therein at locations corresponding to positions of the openings in said housing of said microphone main unit; and an adjustment ring, having a hollow, cylindrical shape to be fitted over a periphery of said packing, for rotating around the periphery of said packing while keeping in contact with the periphery of said packing to form a ventilation path for setting one of the openings in said packing to be communicated with the outside or not to be communicated.

2. The microphone characteristic adjustment device according to claim 1, wherein the openings in said microphone main unit, the openings in said packing, and the ventilation path in said adjustment ring are formed to be openings that are elongated in a periphery direction.

3. The microphone characteristic adjustment device according to claim 2, wherein a width of the elongated openings in said packing is varied along the periphery direction.

* * * * *